US005241885A

United States Patent [19]

Kuchler

[11] Patent Number: 5,241,885

[45] Date of Patent: Sep. 7, 1993

[54] SLICING MACHINE WITH ACCIDENT PROTECTION

[76] Inventor: Fritz Kuchler, Klatteweg 4, A-9010 Klagenfurt, Austria

[21] Appl. No.: 946,869

[22] Filed: Sep. 17, 1992

[30] Foreign Application Priority Data

Oct. 11, 1991 [AT] Austria ..... 2030/91

[51] Int. Cl.[5] ..... B26D 7/22

[52] U.S. Cl. ..... 83/76.7; 83/397; 83/400; 83/435.1; 83/468.6; 83/715; 83/718; 83/DIG. 1

[58] Field of Search ..... 83/72, 76.1, 76.7, 77, 83/397.1, 400, 435.1, 468.1, 468.6, 715, 718, DIG. 1, 397

[56] References Cited

U.S. PATENT DOCUMENTS

| | | | |
|---|---|---|---|
| 1,428,292 | 9/1922 | Lucey | 83/397 |
| 1,722,476 | 7/1929 | Mueller | 83/77 X |
| 3,704,736 | 12/1972 | Pratley | 83/DIG. 1 X |
| 4,541,319 | 9/1985 | Maurer et al. | 83/DIG. 1 X |
| 4,548,107 | 10/1985 | Marchese et al. | 83/77 X |
| 5,129,298 | 7/1992 | Cresson et al. | 83/72 |

*Primary Examiner*—Douglas D. Watts
*Assistant Examiner*—Raymond D. Woods
*Attorney, Agent, or Firm*—Herbert Dubno; Andrew M. Wilford

[57] ABSTRACT

A slicing machine has a housing, a rotatable blade on the housing having an edge defining a blade plane, and an input table on the housing displaceable parallel to the plane past the blade edge and having a holder adapted to hold a foodstuff to be sliced by the blade. The foodstuff is movable from a starting position by the table and holder toward the blade to slice the foodstuff. An abutment plate on the housing is displaceable between a shield position lying generally on the blade plane and a retracted position offset away from the table from the blade plane. An actuator connected between the housing and the plate sets the plate in its positions. A sensor generates an output when the foodstuff is moved out of the starting position. A control unit connected between the sensor and the actuator displaces the plate out of the shield position when the output is generated.

7 Claims, 1 Drawing Sheet

SLICING MACHINE WITH ACCIDENT PROTECTION

FIELD OF THE INVENTION

The present invention relates to a slicing machine. More particularly this invention concerns a motor-driven machine used to slice foodstuffs.

BACKGROUND OF THE INVENTION

A standard slicing machine has an input table that can be reciprocated longitudinally past a rotating disk blade to cut slices from a foodstuff, for instance a piece of meat or cheese, sitting on the input table. An abutment plate extending parallel to the blade plane is spaced slightly behind it by a distance equal to the desired slice thickness. Thus the foodstuff is butted against the plate then slid past the blade to cut a slice from it. On the other side of the blade the slices are picked up by a conveyor, or deposited on an output table. Such machines are described in detail in my earlier U.S. Pat. Nos. 4,185,527, 4,217,650, 4,338,836, 4,379,416, 4,586,409, 4,598,618, 4,763,738, and 4,867,257.

It is standard to provide a servomotor for setting the slice thickness by positioning the abutment plate the desired spacing from the normally stationary blade plane. An input device, normally a knob or even a keypad, is operated to set the desired slice thickness and then the servomotor appropriately moves the abutment plate. In other more automatic systems the slice thickness is established by stepping the input table toward the blade plane a predetermined distance before each slice is cut, in which case the abutment plate is normally retracted somewhat out of the way. Obviously in such an automatic system the input table is provided not only with a holder for the foodstuff, but with drives for moving the foodstuff parallel to and perpendicular to the blade plane.

In order to prevent accidents the input table and blade are provided with shields that effectively prevent the user from being cut by the blade during a normal slicing operation. It is also normally considered good practice to set the slice thickness at zero when the machine is not in use to use the abutment plate as a blade shield, and in fact some machines even have a shield position for the abutment plate that makes it impossible to touch the sharp edge of the blade.

Nonetheless it is fairly common for a person to get cut using such a machine. Once the slice thickness is set, the plate is normally retracted and the blade edge is exposed.

OBJECTS OF THE INVENTION

It is therefore an object of the present invention to provide an improved slicing machine.

Another object is the provision of such an improved slicing machine which overcomes the above-given disadvantages, that is which automatically shields the blade to prevent accidents.

SUMMARY OF THE INVENTION

A slicing machine has according to the invention a housing, a rotatable blade on the housing having an edge defining a blade plane, and an input table on the housing displaceable parallel to the plane past the blade edge and having a holder adapted to hold a foodstuff to be sliced by the blade. The foodstuff is movable from a starting position by the table and holder toward the blade to slice the foodstuff. An abutment plate on the housing is displaceable between a shield position lying generally on the blade plane and a retracted position offset away from the table from the blade plane. An actuator connected between the housing and the plate sets the plate in its positions. A sensor generates an output when the foodstuff is moved out of the starting position. A control unit connected between the sensor and the actuator displaces the plate out of the shield position when the output is generated.

Thus with this system whenever the foodstuff is in the starting position, the plate is set in the blade-shielding position. As soon as a slicing operation is started, the controller automatically moves the plate back. In a manual machine it moves it back a distance from the blade plane equal to the desired slice thickness, which is stored in the controller. In an automatic machine it retracts the blade to the fully back position or to a position slightly more than the desired slice thickness, and the controller then indexes the foodstuff holder toward the blade plane to cut off slices of the desired thickness.

The input table is movable according to the invention between a retracted position relatively far from the blade and an advanced position past the blade edge so that a slice is cut from the foodstuff as the table moves from its retracted to its advanced position. The sensor is connected to the table to generate the output when the table moves out of its retracted position. Alternately a photocell sensor arrangement can detect when the foodstuff approaches the blade, which it only does when moving out of the starting position, and then generates the output. In another system the sensor detects movement of the table and/or holder from their starting positions to trigger retraction of the abutment plate.

According to another feature of this invention a second sensor generates an output when the table is moved into its advanced position. The controller returns the plate to the shield position when the second sensor generates its output. To prevent this from happening between succeeding slices, the controller includes a time-delay circuit for only moving the plate into the shield position when a predetermined time interval has elapsed since the second sensor had generated its output.

In the automatic arrangement, where the holder is movable from a retracted position relatively far from the blade and an advanced position close to the blade, the sensor is connected to the holder to generate the output when the holder moves out of its retracted position.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
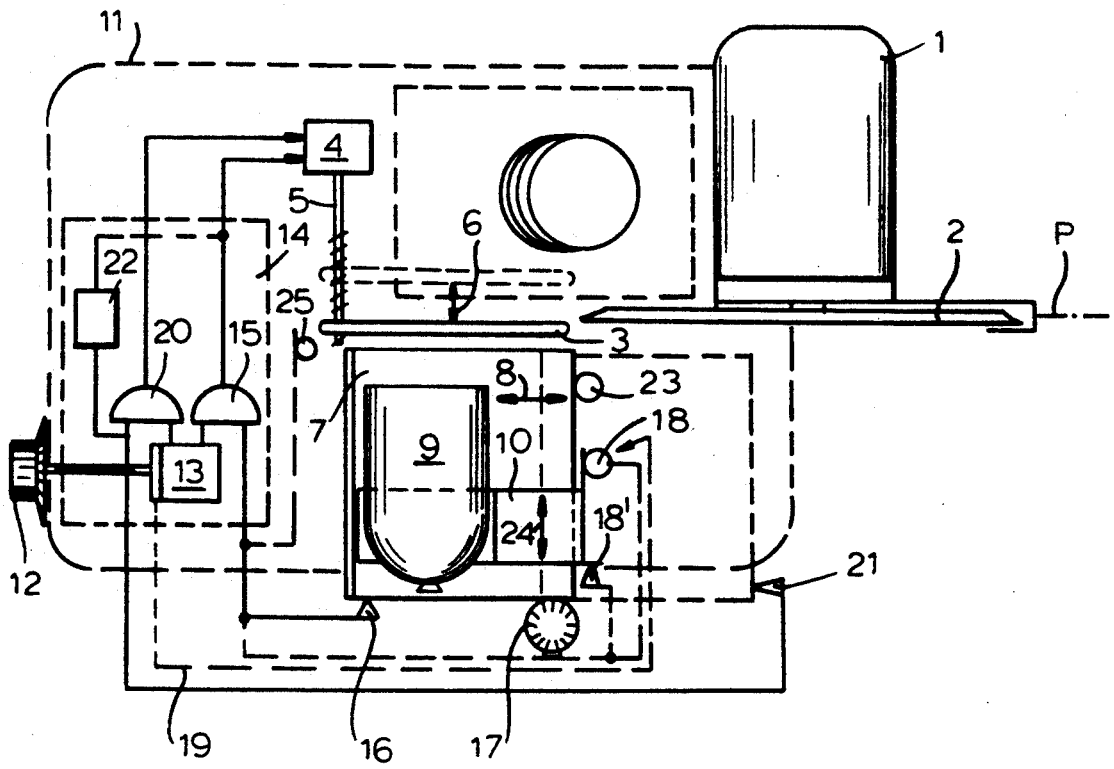
FIG. 1 is a largely diagrammatic top view of the slicing machine of this invention.
Figure 2:
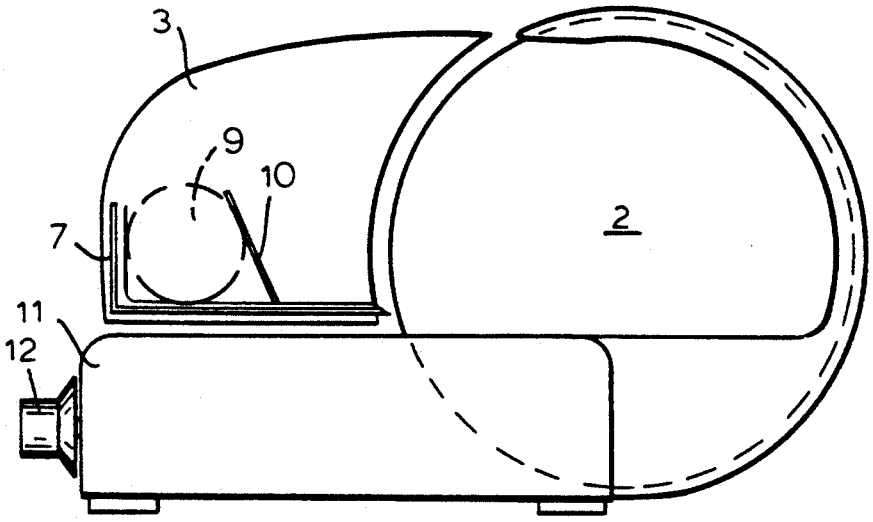
FIG. 2 is an end view of the machine.

As seen in FIGS. 1 and 2 a slicing machine according to the invention has a housing 11 carrying a motor 1 that rotates a disk blade 2 in a blade plane P. An abutment plate 3 is connected via a threaded spindle 5 to an actuator or servomotor 4 so that it can move as indicated by arrow 6 from a solid-line shielding position in front of the blade plane P to a retracted position shown in dashed lines, and of course it can be arrested in any position intermediate these two positions for a desired slice width.

A foodstuff 9 to be cut is secured by a holder 10 on an input table 7 displaceable parallel to the blade plane as indicated by arrow 8 between the solid-line outer end position and the dashed-line fully advanced position. A motor such as shown schematically at 23 can effect this displacement and another motor such as shown at 18 can in fact also move the workpiece 9 and its holder 10 on the table 7 in a direction 24 perpendicular to the blade plane P. The motor 23 or a simple spring arrangement returns the table 7 to the solid-line outer end position after the slicing operation. A knob 12 on the housing 11 is positioned to set the desired slice thickness. All the above-described structure is known.

According to the invention the knob 12 is connected to a memory 13 that stores the desired slice thickness. The output of this memory 13, which is part of a control unit 14, is fed to one input of each of two AND gates 15 and 20 whose outputs are connected to the actuator 4.

In the simplest embodiment the other input of the gate 15 is connected to a sensor 16, here a proximity switch, that is closed to generate an output when the table 7 moves out of its solid-line outer end position, that is the position it is in when furthest from the blade plane P and the position that it is normally in when it is being loaded or unloaded. Thus whenever the table 7 is set in its outer end position the AND gate 15 will not be enabled on both its inputs and the slice thickness will not be fed from the memory 13 to the actuator 4, and the actuator 4 will maintain the plate 3 in the solid-line shield position.

Thus with this system the blade 2 will be shielded except when the input table 7 is being actually moved to make a cut.

Instead of the proximity switch 16, an photocell arrangement 25 can be used to detect the presence of the foodstuff immediately adjacent the blade P and move the abutment plate out of the way. Clearly such a photocell arrangement is set up to respond only to a properly positioned foodstuff, and not to move the plate 3 when something smaller like the user's finger moves near the blade 2.

Alternately, FIG. 1 also shows how a movement detector 17 for the table 7 can send a signal indicating that the table 7 is being displaced to make a cut. This movement detector is a standard slotted plate coupled to the table 17 and associated with magnetic detector.

In a fully automatic machine the controller 14 advances the holder 10 and workpiece 9 by means of the motor 18 in the direction 24 in steps equal to the desired slice thickness. The plate 3 is retracted either into the fully back position shown in dashed lines or to a position about 1 mm further than the desired slice thickness to shield the blade 2 from the back during the slicing operation. Thus in an automatic slicing machine the plate 3 does not serve the same function as in a manual one, but functions mainly as a blade shield.

In such an automatic machine a signal from the drive 18 via a line 19 or, more efficiently, from a proximity switch 18' associated with the holder 10 is used to enable the gate 15 and allow the plate 3 to be retracted. Thus once the automatic slicing operation is started and the holder 10 starts to be stepped toward the plane P, the plate 3 is retracted.

Once the slicing operation is over the plate 3 is returned to the solid-line shielding position. This is effected by a signal from the AND gate 20 whose one input is fed by the memory 13 and whose other input is fed from a sensor 21 that detects when the table 7 is in its fully advanced position. The system can therefore work such that the plate 3 is put back into the shield position after each slice.

According to the invention a time delay 22 is bridged from the proximity switch 21 to the output of the gate 15 to prevent the plate 3 from being set back to the shield position unless a certain time has elapsed since the last slice. This prevents excessive movement of the plate 3 and still provides meaningful protection for the user. Thus if after finishing a slice another slice is not started right away, the plate 3 will move up to shield the blade 2.

While the circuit elements 13, 14, 15, 20, and 22 are shown as separate elements, in practice it is easiest to do their functions with a simple program in a microprocessor that also can store various setups for the slicing machine.

I claim:

1. A slicing machine comprising:

a housing;

a rotatable blade on the housing having an edge defining a blade plane;

an input table on the housing displaceable parallel to the plane past the blade edge and having a holder adapted to hold a foodstuff to be sliced by the blade, the foodstuff being movable from a starting position by the table and holder toward the blade to slice the foodstuff;

an abutment plate on the housing displaceable between a shield position lying generally on the blade plane and a retracted position offset away from the table from the blade plane;

means including an actuator connected between the housing and the plate for setting the plate in its positions;

means including a sensor for generating an output when the foodstuff is moved out of the starting position; and control means connected between the sensor means and the actuator for displacing the plate out of the shield position when the output is generated.

2. The slicing machine defined in claim 1 wherein the input table is movable from a retracted position relatively far from the blade and an advanced position past the blade edge, whereby a slice is cut from the foodstuff as the table moves from its retracted to its advanced position, the sensor being connected to the table to generate the output when the table moves out of its retracted position.

3. The slicing machine defined in claim 2, further comprising means including a second sensor for generating an output when the table is moved into its advanced position, the control means including means for returning the plate to the shield position when the second sensor generates its output.

4. The slicing machine defined in claim 3 wherein the control means includes a time-delay circuit for only moving the plate into the shield position when a predetermined time interval has elapsed since the second sensor generates its output.

5. The slicing machine defined in claim 1 wherein the holder is movable from a retracted position relatively far from the blade and an advanced position close to the blade, the sensor being connected to the holder to generate the output when the holder moves out of its retracted position.

6. The slicing machine defined in claim 1 wherein the sensor detects movement of the table toward the blade and generates its output when detecting such movement.

7. The slicing machine defined in claim 1 wherein the control means includes a memory for storing a signal corresponding to desired slice thickness and for feeding this signal to the actuator to set the plate when the output is generated.

* * * * *